United States Patent [19]

Abell, Jr. et al.

[11] 4,402,621

[45] Sep. 6, 1983

[54] RIBBON CARTRIDGE WITH RIBBON GUIDE ARMS

[75] Inventors: William A. Abell, Jr., Wilmore; James A. Craft; Michael L. Morris, both of Lexington, all of Ky.

[73] Assignee: International Business Machines Corp., Armonk, N.Y.

[21] Appl. No.: 305,764

[22] Filed: Sep. 25, 1981

[51] Int. Cl.[3] ..... B41J 35/28

[52] U.S. Cl. ..... 400/208; 400/196

[58] Field of Search ..... 400/194, 195, 196, 196.1, 400/207, 208, 208.1

[56] References Cited

U.S. PATENT DOCUMENTS

| | | | |
|---|---|---|---|
| Re. 31,117 | 1/1983 | Depew . | |
| 2,252,075 | 8/1941 | Johnson . | |
| 3,731,781 | 5/1973 | Caudill et al. | 400/230 X |
| 3,830,351 | 8/1974 | Cappotto . | |
| 3,882,989 | 5/1975 | Morelli . | |
| 3,899,065 | 8/1975 | Brignole . | |
| 3,900,099 | 8/1975 | Hengelhaupt . | |
| 3,904,016 | 9/1975 | Hengelhaupt . | |
| 3,923,141 | 12/1975 | Hengelhaupt . | |

OTHER PUBLICATIONS

*IBM Technical Disclosure Bulletin*, "Ribbon Cartridge," vol. 17, No. 4, Sep. 1974, pp. 1118–1119.

IBM Technical Disclosure Bulletin, vol. 19, No. 8, Jan. 1977, pp. 2978–2979 "Printer Ribbon Cassette" by Brumbaugh et al.

*Primary Examiner*—Edgar S. Burr

*Assistant Examiner*—Charles A. Pearson

*Attorney, Agent, or Firm*—John A. Brady

[57] ABSTRACT

A ribbon cartridge having a supply spool (3) and a take-up spool hub (27) to receive ribbon (1). Ribbon guide arms (9) are pivoted on pins (62) on the wall (17) of the cartridge. Downward bias is provided by a single spring (11) in a housing (13). A central section (60 ) is biased by the spring (11). The central section (60) may be grasped to move the guide arms 9 upward.

8 Claims, 4 Drawing Figures

RIBBON CARTRIDGE WITH RIBBON GUIDE ARMS

DESCRIPTION

1. Technical Field

This invention relates to a ribbon cartridge having a supply spool mounted for rotation in the cartridge and a take-up spool hub also mounted in the cartridge to receive ribbon which extends from the supply spool, out of the cartridge, and then back into the cartridge. The cartridge includes integral, pivoted ribbon guide arms.

2. Background Art

Ribbon cartridges for typewriters provide convenient, more clean-handling loading and unloading. The cartridge originally contains the supply spool of transfer medium, mounted to be controllably unwound, and a hub mounted to wind up the used spool.

Cartridges are known having pivoted ribbon guides integral with the cartridge through which the ribbon is threaded at the factory. Accordingly, the ribbon need not be handled at all. This is particularly advantageous where the ribbon is difficult to handle, as where it is very thin and difficult to position.

The cartridge of this invention differs in having a housing containing a spring which pushes against a top center element of the guide to bias the guide downward. The typewriter pushes the arms of the guide upward during each printing operation. The cartridge also differs in having the center element perform a separate function in that it is suited to be grasped to lift the ribbon manually during handling of the cartridge.

DISCLOSURE OF THE INVENTION

In accordance with this invention a pivoted, ribbon guide is mounted as part of the cartridge. The top, center of the cartridge has a housing containing a spring which pushes against a top center element of the guide to bias the guide downward. The typewriter pushes the arms of the guide upward during each printing operation. The center element of the guide has a separate function in that it is grasped to lift the ribbon manually during handling of the cartridge.

This is achieved by a single coil in a housing integrally molded with the top wall. This is an inexpensive design as compared with two or more springs and the design responds and functions well.

BRIEF DESCRIPTION OF THE DRAWINGS

This invention is described in detail below with reference to the accompanying drawing, which illustrates the preferred embodiment, in which.

BEST MODE FOR CARRYING OUT THE INVENTION

Figure 1:
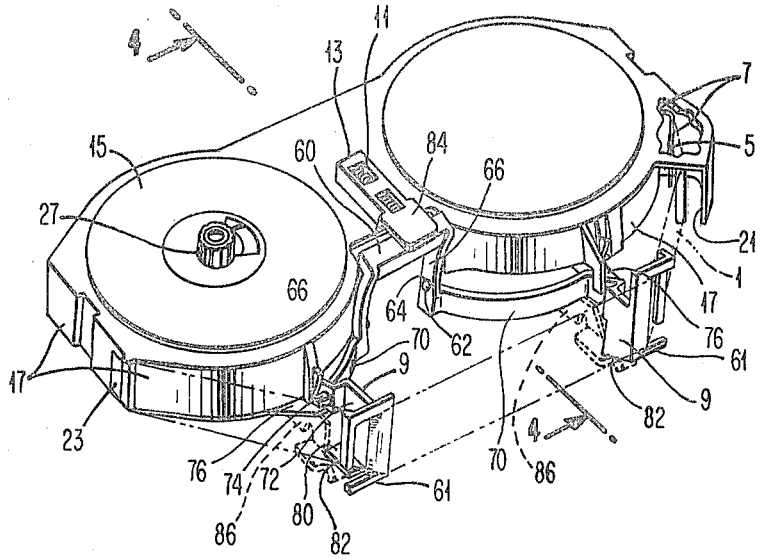
FIG. 1 is a perspective view from the top, front illustrating a cartridge incorporating this invention.

As shown in FIG. 1, this invention is embodied in a cartridge from which the typewriter ribbon 1 or the equivalent exits from a supply spool 3 (FIG. 2) by riding over a depending leg 5 of a wire 7. In this preferred embodiment the cartridge has integral, laterally spaced guide arms 9 which are pivoted to the cartridge and are biased downward by a single coil spring 11 in top-central spring housing 13.

Figure 2:
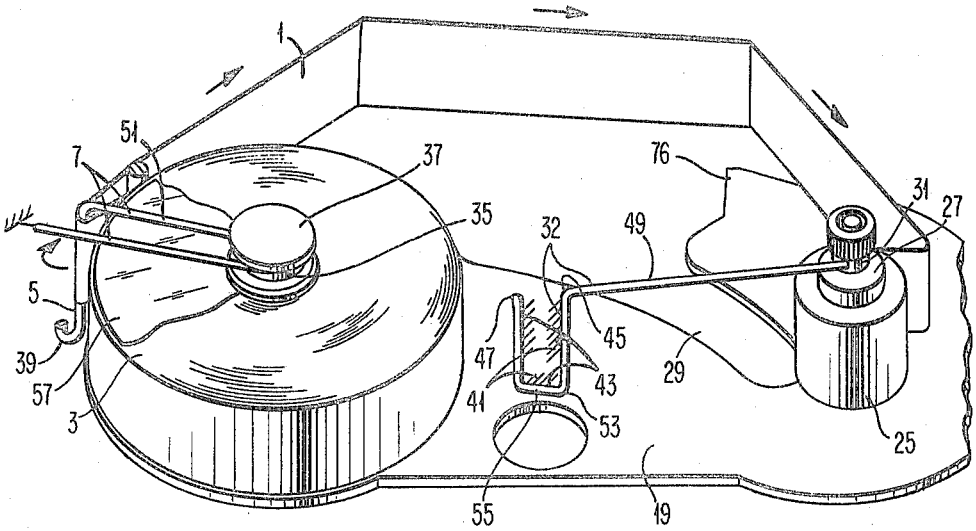
FIG. 2 is a perspective view from the rear illustrating the ribbon, major elements within the cartridge of FIG. 1, and the bottom wall of the cartridge.

The cartridge has wall members including a top wall 15, side walls 17, and a bottom wall 19 (FIG. 2). Ribbon 1 exits the cartridge through an exit opening 21 formed in side wall 17 at the area of wire leg 5. Ribbon 1 reenters the cartridge in opening 23 on side wall 17 opposite exit opening 21.

Referring to FIG. 2, ribbon 1 is directed to a take-up spool 25, which is wound on take-up hub 27. In a manner now well known, a drive sprocket from the typewriter enters bottom wall 19 of the cartridge through an arcuate slot 29 and contacts the periphery of take-up spool 25 to wind the ribbon. Take-up hub 27 has a smooth shaft 31 above spool 25 on which rests the end of a second wire 32.

Figure 3:
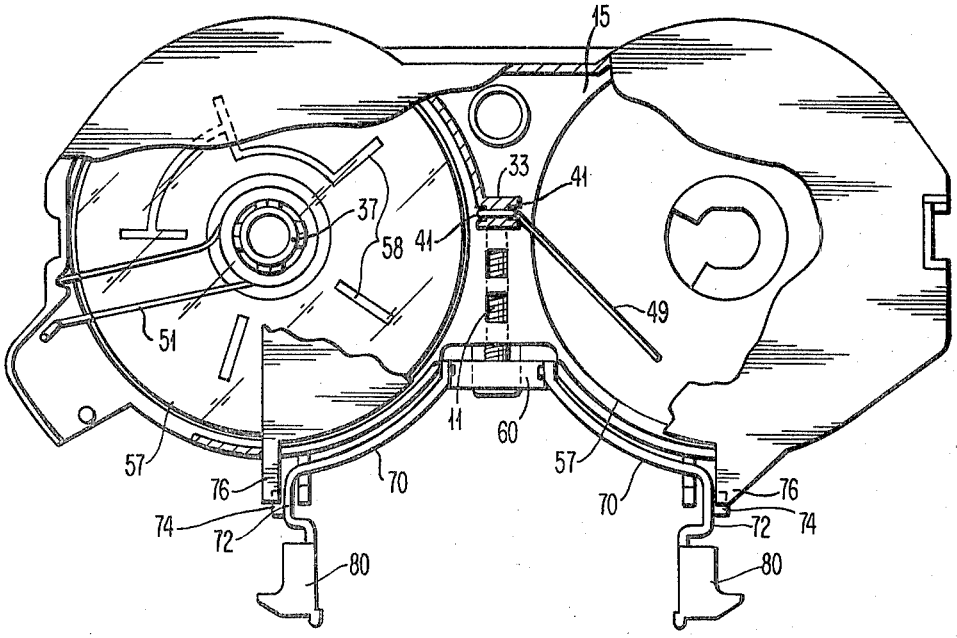
FIG. 3 is a view from the bottom with the bottom wall and spools removed showing the mounting of the cartridge with guide arms.

Wire 32 extends freely from the contact with shaft 31 to a mounting post 33 (FIG. 3, shown illustratively in FIG. 2), integral with the top wall 15 of the cartridge. Wire 7, not part of wire 32, is wrapped tightly around groove 35 of the extension of the supply spool hub 37. Wire 7 is deformed to a predetermined position approximately at right angles to form depending leg 5 upon which ribbon 1 rides upon as it exits the cartridge. A hooked end 39 of leg 5 prevents ribbon 1 from slipping downward off of leg 5.

FIG. 3 illustrates the mounting of the wire 32 in the cartridge by showing the position of wire 32 when neither spools or hubs are in the cartridge. Post 33 has grooves 41 on three sides, in which a corresponding generally rectangularly shaped part 43 (FIG. 2) of wire 32 is inserted. Grooves 41 on post 33 form three-sided outline which plane is parallel to a line between the centers of the supply hub 27 and the take-up hub 27. Stated differently, with reference to FIG. 1, its plane is parallel to the span of ribbon 1 between arms 9.

Wire 32 is bent at the junction 45 of the rectangular part 43 and the straight section 49 which extends to hub 27. Thus, with reference to FIG. 2, wire 32 is bent 40 degrees counterclockwise at junction 45, thereby pointing section 49 of wire 32 to the relaxed position shown in FIG. 3. The position of section 49 in the completed cartridge is shown in FIG. 2. Section 49 is pulled across the location for take-up hub 27. Hub 27 is inserted and section 49 is released. The 40 degree bend thereby provides a recovery force biasing the end of section 49 firmly against shaft 31 of take-up hub 27.

Wire 7 in the configuration as disclosed is substantially identical to prior published and commercially sold tensioning systems for a supply ribbon in a cartridge. It therefore constitutes no part of this invention and will not be discussed in detail. One end of wire 7 is anchored to the cartridge. The end carrying depending leg 5 is pulled by ribbon 1 as the ribbon is fed. This relaxes the normally firm grip of wire 7 around hub 37 and allows rotation of hub 37 to thereby feed ribbon from supply spool 3.

The generally rectangular part 43 of wire 32 is actually bent somewhat to create a grasping bias on post 33. This is accomplished by a bend in junction 53, the next corner of part 43 from junction 45. That bend is inward so that the opening opposite the central leg 55 of the part 43 when relaxed is about one-third larger than the spaced opening between junction 45 and the end 47 of rectangular part 43.

It will be apparent that the foregoing dimensions are essentially only matters of optimum design. Increasing the disclosed angle at junction 45 requires a greater bending of section 49 after the cartridge is assembled and therefore provides a greater biasing force. The degree of inward bending of part 43 controls grasping bias when the part is flexed over post 33, which bias provides friction to keep wire 32 in place. As indicated best in FIG. 3, a moderately stiff plastic disk 57 with a central hole to admit supply spool hub 37 is included in the cartridge. Top wall 15 has a series of ridges or ribs 58 which hold disk 57 in a plane between supply spool 3 and wire 7. Disk 57 holds ribbon 1 against taking a coned or telescoped configuration under unwinding pressures which would bind wire 7 from its intended movement. The end of section 49 of wire 32 is cut at 45 degrees so as to provide a sharp, digging contact with hub 27.

Wires 7 and 32 and their mounting in connection with the hubs 27 and 37 and the ribbon 1 form no part of the essential contribution of this invention, except as they interact with the guide arms 9. This invention contributes the central housing 13 with single spring 11, and a central section 60 integral with the ribbon guides arms 9 as will be more specifically described.

The specific configuration of the guide arms 9 comprises yokes 61, spaced apart and slidably holding ribbon 1. The guide arms 9 are pivoted on pins 62 near the front, center of the cartridge. Pins 62 are located substantially spaced under the housing 13 and spring 11. Pins 62 are integral with side walls 17 and mesh with holes 64 in guide arms 9.

From holes 64 arms 9 have generally upwardly disposed sections 66, which are joined together in a central, horizontal section 60 generally contiguous to housing 13 so as to be contacted and biased by spring 11. Extending outward from holes 64 are curved sections 70, which are curved so as to generally conform with the curvature of the cartridge. Each section 70 connects to straight sections 72, having an outward ledge 74. Ledges 74 rest on ledges 76 when spring 11 pivots guide arms 9 forward on pins 62. Ledges 76 are formed by extensions of bottom wall 19.

Sections 72 connect to yoke 61 and a wide, bottom part 80, having a straight upwardly sloping guide surface 82 on the bottom. In this embodiment all of the structures integral with the guide arms 9 are molded as a single piece.

Housing 13 has an overhanging section 84 on the top, under which central section 60 passes when spring 11 is depressed. During normal typing operations typewriter structures 86 (FIG. 1) push guide surfaces 82 upward during periods of actual printing. Also, during handling the human operator may grasp the cartridge with a finger on central section 60, thereby pivoting arms 9 upward and raising ribbon 1 in yokes 61. The position with section 60 forced under ledge 84 is shown in FIG. 1 and in FIG. 3. The position with spring 11 predominating, as when the cartridge is mounted and the machine is between printing operations, is shown in solid outline in FIG. 4. The lowest position is established when the ledges 74 on arms 9 encounter ledges 76.

Figure 4:
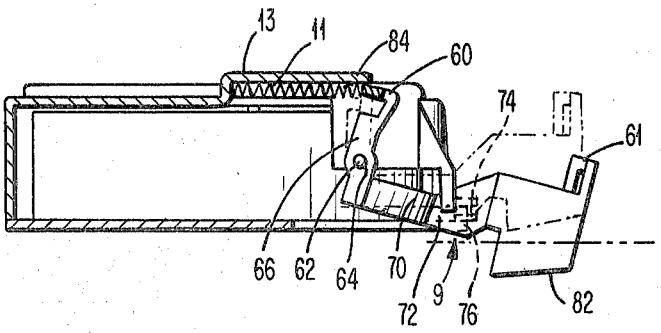
FIG. 4 is a side view sectioned through the plane 4—4 in FIG. 1.

The final cartridge is as it appears in FIG. 1 and FIG. 4 with internal elements of interest as shown in FIG. 2 and FIG. 3. The cartridge is simply placed on a typewriter or other printer adapted to use such a cartridge. Preferably it is grasped with a finger pushing central section 60 inward. As is generally conventional, the cartridge fits on mating members on the typewriter so as to be positioned for printing. A drive sprocket from the typewriter enters the bottom of the cartridge through slot 29 and rests against the outside of take-up spool 25. The drive sprocket and slot interaction is now well known as shown, for example, in U.S. Pat. No. 3,731,781 to Caudill et al. Typewriter elements 86 contact guide surfaces 82 and rotate upward to pivot arms 9 upward when ribbon 1 is to be raised for actual printing.

Section 49 of wire 32 provides a back-checking operation. When hub 27 moves in the unwind direction, movement is toward the end of section 49. Section 49 is firmly tensioned toward the center of hub 27 and therefore engages the hub 27. The 45 degree angle at the end of section 49 presents a point which assists in providing a firm engagement. This applies a force which being along the length of section 49, is strongly resistive to flexing. A strong counter force effective to brake the hub 27 results. In the preferred embodiment hub 27 is made of a hard synthetic resin which yields slightly to the digging action of wire 32.

Modifications of the preferred embodiment will be apparent, and other, not apparent modifications and adaptations may be devised while nevertheless employing the true invention here disclosed. Accordingly, patent protection should not be limited by the preferred embodiment, but should be provided by law.

What is claimed is:

1. A printer ribbon cartridge having a top wall, a bottom wall and side walls, and a ribbon guide and containing a printer ribbon, a first hub upon which said ribbon is wound, a second hub upon which said ribbon is wound, said walls defining an area for a spool of ribbon wound on said first hub and an area for a spool wound on said second hub, and defining an exit for said ribbon from one of said spools, through said ribbon guide, and to the other of said spools, said ribbon guide being pivoted and held on said cartridge, a housing on one of said top and bottom walls on the outside, center of said cartridge holding a resilient member contained within said housing, and a part central to and integral with said guide spaced from the location at which said guide is pivoted, said part being generally contiguous with said housing with said resilient member contacting and resiliently biasing said part.

2. A printer ribbon cartridge as in claim 1 in which said resilient member is a single coil spring mounted in said housing.

3. A printer ribbon cartidge as in claim 1 in which said housing has an overhang portion under which said part is positioned when said resilient member is compressed.

4. A printer ribbon cartridge as in claim 3 in which said resilient member is a single coil spring mounted in said housing.

5. A printer ribbon cartridge as in claim 3 also comprising a ledge on said ribbon guide and a ledge on the outside of said walls, said ledge on said ribbon guide and said ledge on said walls abutting to limit movement of said guide under the bias of said resilient member.

6. A printer ribbon cartridge as in claim 4 also comprising a ledge on said ribbon guide and a ledge on the outside of said walls, said ledge on said ribbon guide and said ledge on said walls abutting to limit movement of said guide under the bias of said spring.

7. The printer ribbon cartridge as in claim 5 in which said guide comprises two, spaced arms integral with spaced yokes slidably holding said ribbon, said arms each being pivoted at the front of said cartridge at locations substantially spaced from said resilient member and two generally upwardly disposed sections each integral with one of said arms, said upwardly disposed sections being integral with said central part.

8. The printer ribbon as in claim 6 in which said guide comprises two, spaced arms integral with spaced yokes slidably holding said ribbon, said arms each being pivoted at the front of said cartridge at locations substantially spaced from said coil spring and two generally upwardly disposed sections each integral with one of said arms, said upwrdly disposed sections being integral with said central part.

* * * * *